United States Patent [19]

Palmer

[11] Patent Number: 4,961,514

[45] Date of Patent: Oct. 9, 1990

[54] REFUSE BINS

[75] Inventor: Thomas E. Palmer, Lancashire, United Kingdom

[73] Assignee: Glasdon Limited, United Kingdom

[21] Appl. No.: 51,243

[22] Filed: May 14, 1987

Related U.S. Application Data

[63] Continuation of Ser. No. 690,949, Jan. 14, 1985, abandoned.

[51] Int. Cl.[5] ..... B65F 1/08; B65D 41/06

[52] U.S. Cl. ..... 220/408; 220/293; 220/908; 232/43.2

[58] Field of Search ..... 220/1 T, 293, 300, 301, 220/404, 408, 409, 410; 223/43.1, 43.2, 43.3, 43.4, 43.5

[56] References Cited

U.S. PATENT DOCUMENTS

| | | | |
|---|---|---|---|
| 646,163 | 3/1900 | Bachner | 220/1 T |
| 937,409 | 10/1909 | Caller | 220/409 |
| 1,052,379 | 2/1913 | Ranken | 220/404 |
| 1,351,747 | 9/1920 | Flinn | 220/1 T |
| 1,477,404 | 12/1923 | Watson | 220/1 T |
| 1,698,683 | 1/1929 | Reynolds | 220/404 |
| 2,817,476 | 12/1957 | Mills | 232/43.1 |
| 3,102,659 | 9/1963 | Bowden | 220/301 |
| 3,190,039 | 6/1965 | Carlson | 220/408 |
| 3,275,180 | 9/1966 | Optner | 220/408 |
| 3,649,793 | 3/1972 | Corn | 220/300 |
| 3,927,786 | 12/1975 | Aboud | 220/404 |
| 4,206,842 | 6/1980 | Burridge | 220/408 |

FOREIGN PATENT DOCUMENTS

| | | | |
|---|---|---|---|
| 1268569 | 6/1961 | France | 220/1 T |
| 1503773 | 10/1967 | France | 220/293 |
| 351575 | 7/1931 | United Kingdom | 220/408 |
| 1144404 | 3/1969 | United Kingdom | 220/293 |

*Primary Examiner*—George E. Lowrance

*Attorney, Agent, or Firm*—Roylance, Abrams, Berdo & Goodman

[57] ABSTRACT

The disclosure relates to a refuse bin comprising an open topped container for refuse, a shallow base having means to mount the refuse holder on the base and a one-piece removable cover for enclosing the refuse holder, the cover having a lower periphery which engages with the base to support the cover on the base around the refuse holder and an upper part extending above the upper end of the refuse holder and being formed with a port or ports disposed above the upper end of the refuse holder through which refuse may be passed into the holder within the cover and having an integral upper end wall closing the upper end of the cover.

27 Claims, 4 Drawing Sheets

REFUSE BINS

This is a continuation of application Ser. No. 690,949 filed Jan. 14, 1985 now abandoned.

BACKGROUND OF THE INVENTION

1. Field of the Invention

This invention relates to refuse bins and is particularly applicable to bins for siting in public positions such as pavements, car-parks and other similar open spaces to receive litter.

2. Description of the Prior Art

U.K. Patent Specification No. 239021 discloses a refuse bin haing a base above which is a removably supported bin body having a side opening door for a disinfectant holder and also a top lid for closing the body. Refuse is placed direct in the bin body.

U.K. Patent Specification discloses a refuse or litter bin having an inner refuse holder and an outer body which hinges open about a vertical axis to enable the holder to be removed for emptying.

SUMMARY OF THE INVENTION

This invention provides a refuse bin comprising an open topped container for refuse, a shallow base having means to mount the refuse holder on the base and a one-piece removable cover for enclosing the refuse holder, the cover having a lower periphery which engages with the base to support the cover on the base around the refuse holder and an upper part extending above the upper end of the refuse holder and being formed with a port or ports disposed above the upper end of the refuse holder through which refuse may be passed into the holder with the cover.

The cover may have an integral upper end wall closing the upper end of the cover. In a preferred form of the invention means may be provided for locking the cover to the base to prevent the cover from being lifted from the base.

The holding means between the cover and the base may be engaged and released by relative rotation between the cover and the base.

The holding means between the cover and base may comprise one or more bayonet and slot action devices acting between the cover and the base. For example, the base may have an upstanding sleeve with which the lower part of the cover is concentric and the bayonet and slot devices may be provided between the sleeve and said lower part of the cover.

A locking device may also be provided between the bottom of the cover and the sleeve.

DESCRIPTION OF THE PREFERRED EMBODIMENT

Figure 1:
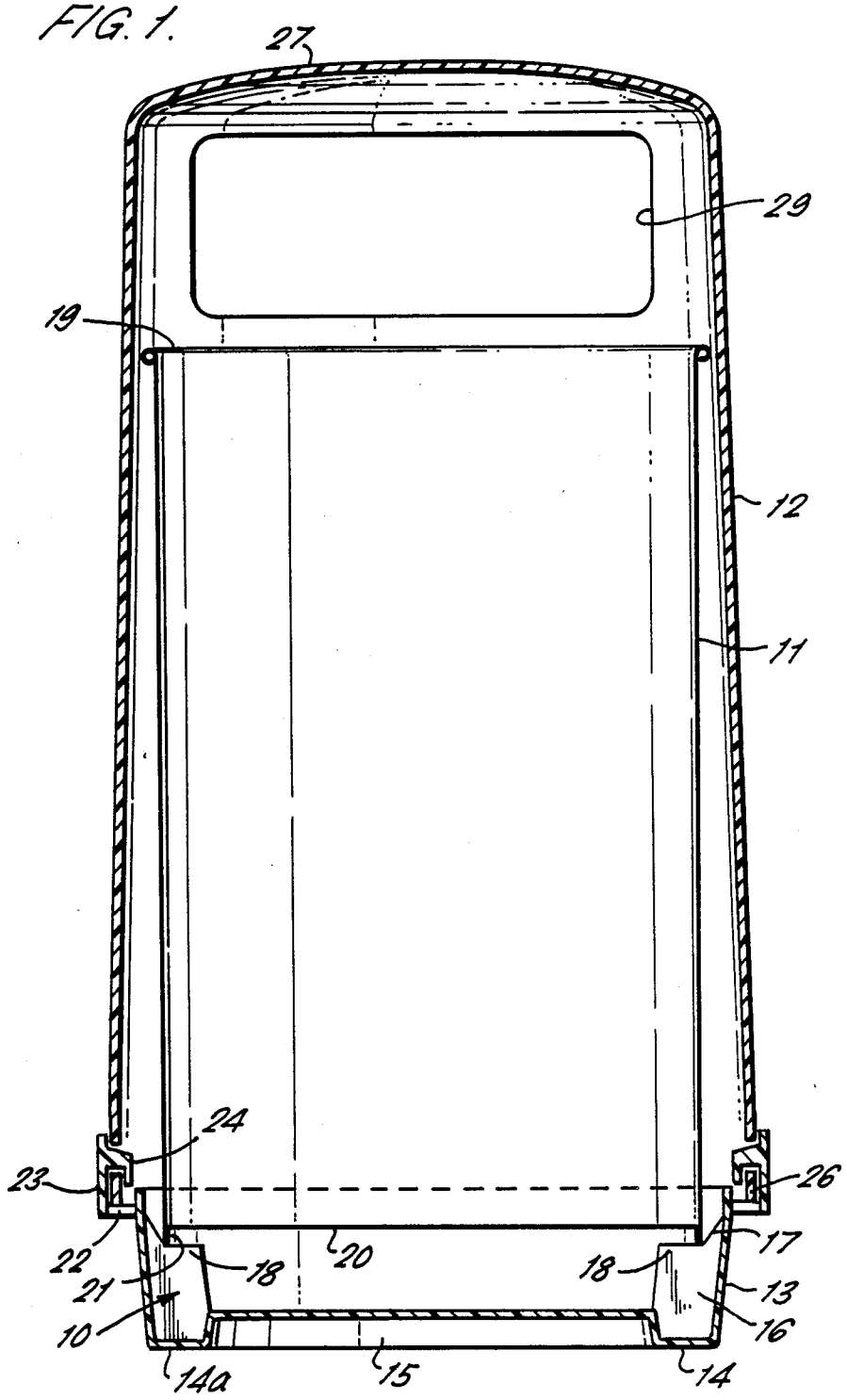
FIG. 1 is a sectional view through a litter bin.

Referring to the drawings, a litter bin is illustrated comprising a base or plinth 10 on which a container 11 for rubbish is mounted and a cover 12 enclosing the container and attached to the base 10.

The base 10 is a plastics injection moulding comprising an upstanding annular wall 13 which tapers slightly in a downwards direction and terminates in an integral bottom wall 14. The bottom wall 14 has a shallow central recess 15 to leave a narrow portion **14*a* of the bottom 14 extending around the lower edge of the annular wall 13** to bear on the ground.

Four radially extending lugs 16 are formed between the annular wall 13 and the base 14 at equi-spaced positions around the wall, the lugs terminating above the perimeter of the recess 15 in the bottom of the base. The upper edge of each lug comprises a ramp 17 extending downwardly and inwardly from the annular wall 13 and terminating in a horizontally extending ledge 18. The lugs receive, locate and support the bottom of the inner refuse container 11 which is fabricated from sheet steel and is of generally cylindrical form having an open top 19, a bottom wall 20 and a shallow peripheral skirt 21 encircling the bottom wall and resting on the ledges 18 of the lugs.

Figure 2:
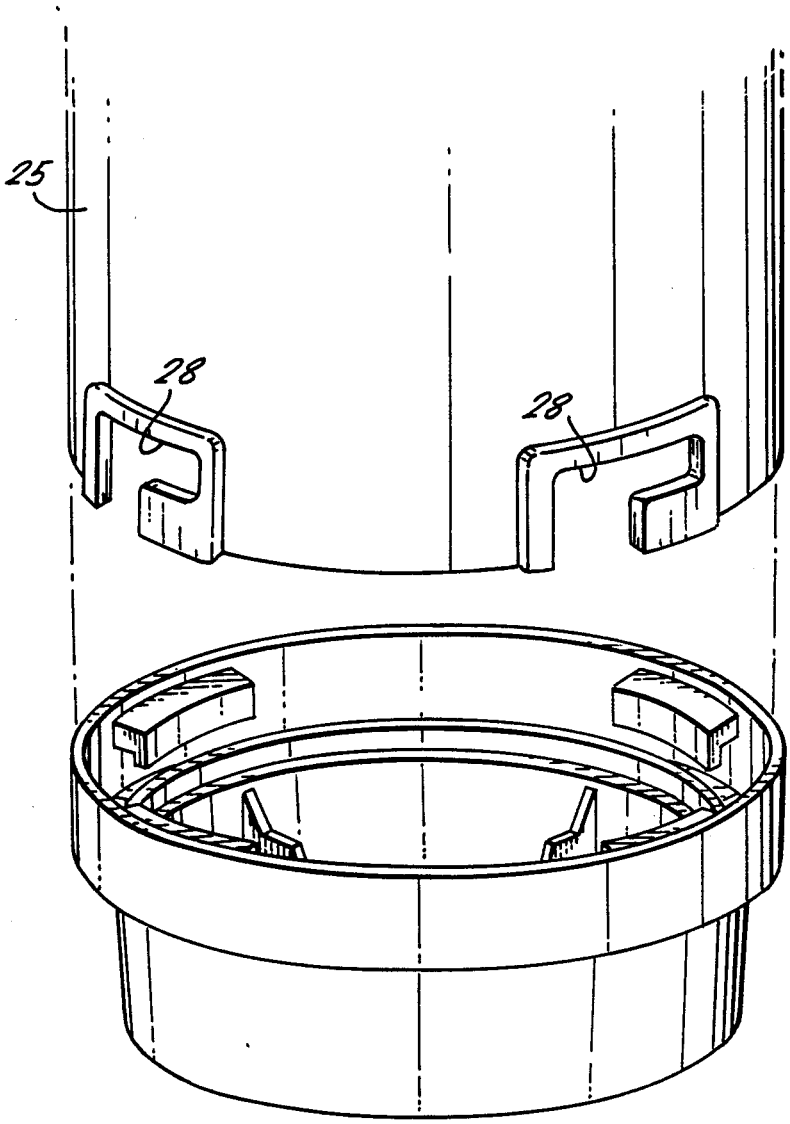
FIG. 2 is a perspective view of a lower part of the bin.

The annular wall 13 of the base 10 is formed on its outer side adjacent the upper periphery of the wall with an outwardly extending flange 22 the outer periphery of which is formed with an upstanding cylindrical outer wall 23 which projects a short distance above the upper edge of the wall 13. The inner periphery of the outer wall 23 is formed with four equi-spaced downwardly facing bayonet action lugs 24. The outer cover 12 for the bin is a plastics rotational or injection moulding and comprises an annular side wall 25 having a lower open end 26 and tapering towards its upper end which is formed with an integral dome top wall 27. The lower part of the wall 25 of the cover is formed with four equi-spaced bayonet slots 28 dimensioned to receive an engage with the bayonet lugs 24 on the base. The cover is attached to the base by locating the open mouths of the slots 28 in the cover over the lugs 24 and then lowering the cover until the open end 26 of the cover engages the flange 22. The cover is then rotated to move the lugs 24 into the closed parts of the bayonet slots 28 out of alignment with the open ends of the slots to prevent the cover from being lifted off the base. As best seen in FIG. 2 of the drawings, the wall thickness of the cover 25 around the bayonet slots 28 is increased on the outer side of the cover to strengthen the cover and thereby resist loads imposed on it by the bayonet lugs.

Referring again to FIG. 1 of the drawings, it will be seen that the upper part of the cover 25 extends above the top of the inner container 11 and large rectangular ports 29 are formed therein on either side of the cover through which rubbish can be fed into the inner container 19.

When the container 19 is full and is to be emptied, the cover 12 is released from the base by simply rotating the cover with respect to the base until the lugs 24 are aligned with the open mouths of the bayonet slots 28. The cover is then raised from the base over the inner container leaving the inner container exposed. The container can them be simply lifted from the base and emptied. The problem of having to lift the full container out of a bin having an upstanding side wall formed integrally with the base with a detachable upper cover or head is therefore avoided.

Figure 3:
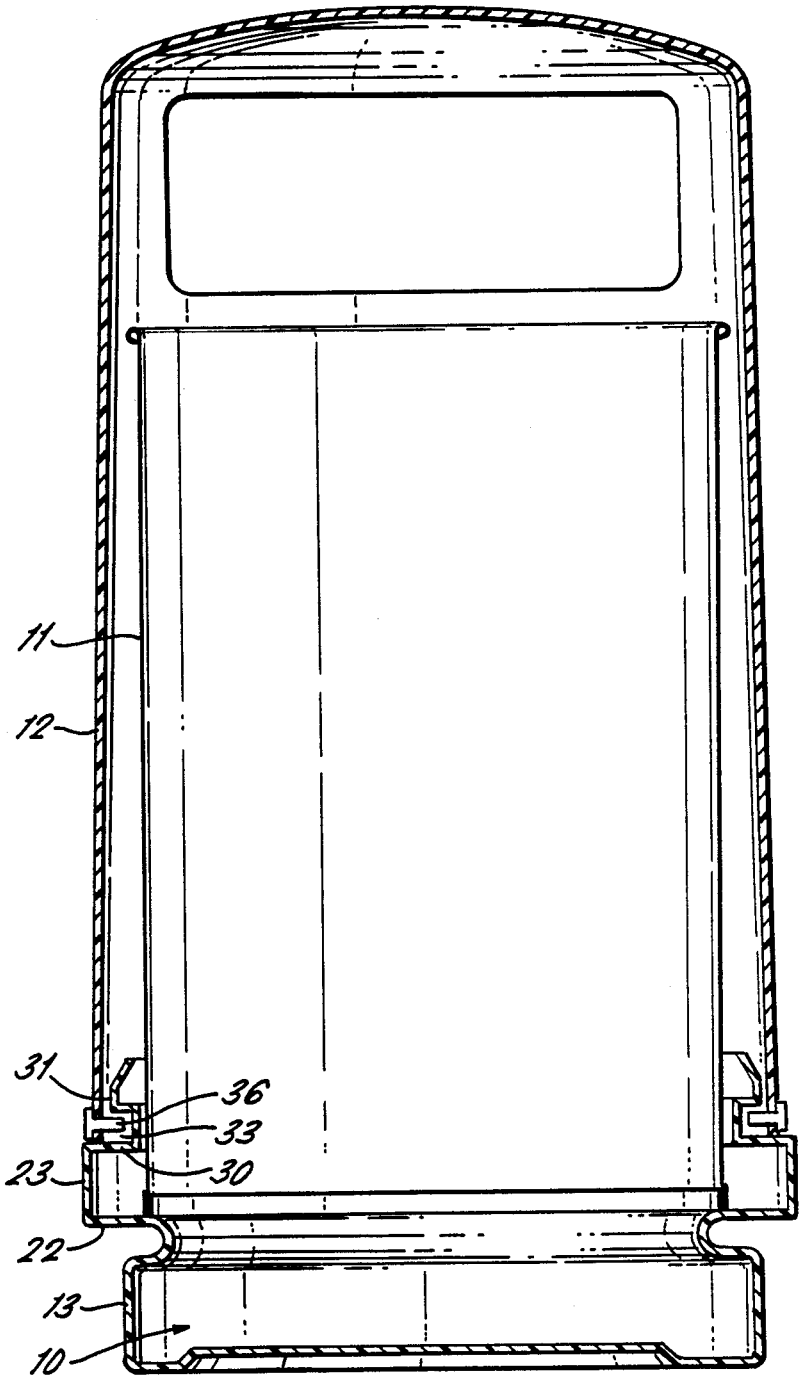
FIGS. 3 to 5 show an alternative construction.
Figure 4:
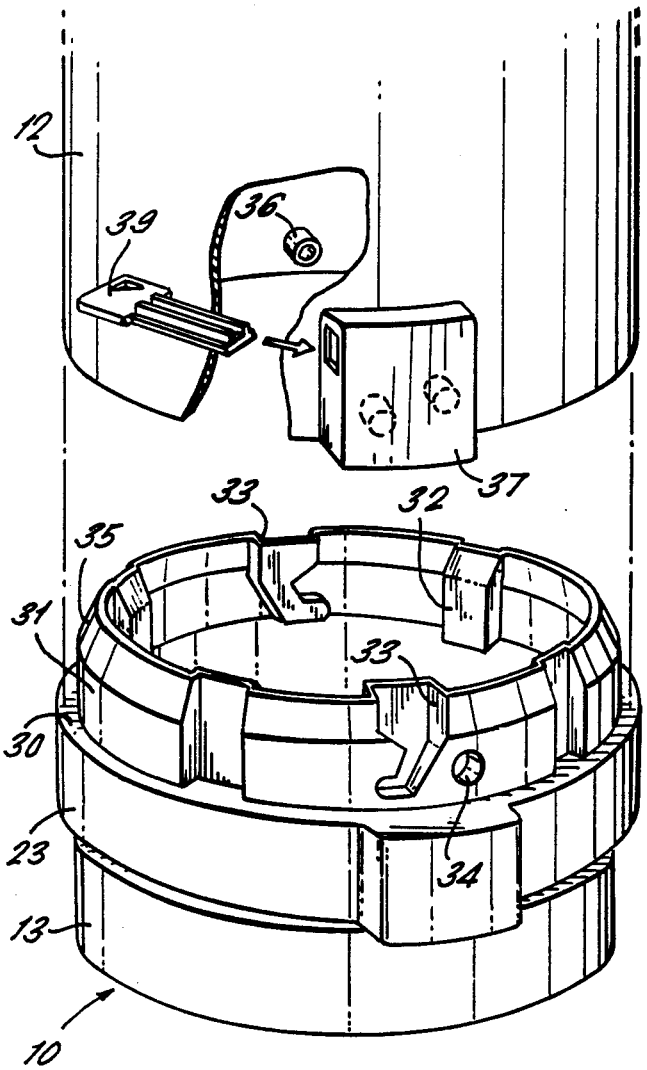
Figure 5:
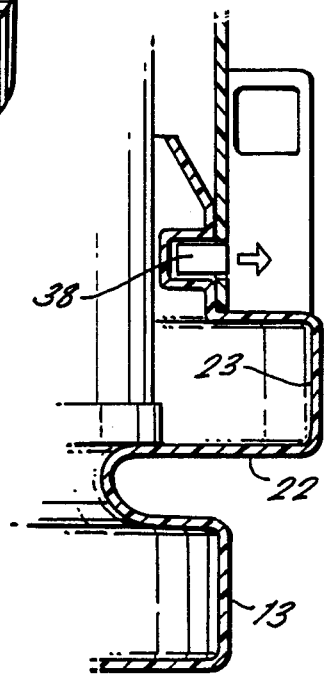

Reference is now made to FIGS. 3 to 5 of the drawings which show a further construction. Like parts of the bin as illustrated in FIGS. 3 to 5 have been given the same reference numerals as those of the embodiment illustrated in FIGS. 1 and 2. The base 10 of the bin of FIGS. 3 to 5 has an inwardly extending annular step 30 at the upper end of the outer wall 23 to receive the lower peripheral edge of the cover 12. This step is formed at its inner edge with an upstanding sleeve 31 to project inside the cover 12. The sleeve is formed around its inner surface with four equi-spaced downwardly extending ribs 32 to guide and centralise downwardly of the container 11 which seats on the flange 22 of the base as best seen in FIG. 5. The outer surface of the sleeve 31 is formed with a pair of bayonet slots or recesses 33 at diametrically spaced locations around the sleeve and adjacent to one of the slots 33 there is a circular recess 34 in the outer surface of the sleeve. The upper edge portion of the sleeve is formed with a taper 35 to assist in locating the lower edge of the cover 12 on the base. The lower portion of the cover 12 is formed with two bayonet pegs 36 at diametrically spaced locations around the inside of the cover to engage in the bayonet slots 33 on the sleeve of the base to hold the cover to the base. In order to lock the cover to the base, a lock device 37 is mounted on the outer side of the cover adjacent one of the pegs 36 and has a spring loaded locking pin 38 which projects through the wall of the cover adjacent to one of the pegs 36. As the cover is lowered onto the base around the sleeve 31, the tapered edge portion 35 of the sleeve causes the spring loaded locking pin 38 to retract into the lock body. When the cover is rotated to engage the pegs 36 in the closed end parts of the bayonet slots 33, the spring loaded locking pin 38 moves into alignment with the circular recess 34 in the sleeve and projects into the recess to hold the cover to the base. A key 39 is provided engageable in the lock body to retract the spring loaded pin 38 when the cover is to be removed from the base.

In the embodiments described above, rigid walled containers are provided for the bins. The invention is, however, equally applicable to bins for holding flexible walled liners or sacks in which case a frame is mounted on the base having an upper rim which is supported just below the openings 29 through the cover and means are provided for attaching the mouth of the bag or sack around the rim to suspend the bag from the rim and hold the bag mouth open to receive refuse. The arrangement is otherwise similar to those described above.

I claim:

1. A refuse bin, comprising:

an open topped, refuse container with a bottom end and an upper end;

a shallow base having a bottom wall, an upstanding peripheral wall encircling the bottom wall and first support means, within the base and disposed above the bottom wall, for receiving the refuse container on the base, for supporting the container with the bottom end of the container spaced by a gap above the bottom wall of the base and for holding the bottom end of the container against lateral movement with respect to the base;

a one-piece removable cover for enclosing the open topped container, the cover being open at one end engaging the base and closed at an opposing end providing a closure over the upper end of the container, the opposing end of the cover projecting beyond the upper end of the container, the cover having a lateral wall with at least one side aperture therein through which refuse may be passed into the container within the cover;

second support means disposed around the peripheral wall of the base below an upper peripheral edge thereof, the open one end of the cover extending around the upper peripheral edge of the base and engaging the second support means; and holding means, provided between the cover at the open one end and part of the peripheral wall of the base extending above the support means for holding releasably the cover on the base.

2. A bin as claimed in claim 1 wherein said first support means comprises a plurality of radially extending lugs, each of said lugs having a ramp extending downwardly and inwardly to a horizontally extending ledge, the ledges defining a diameter substantially equal to that of said bottom end of the container and being spaced of the bottom wall of the base.

3. A bin as claimed in claim 1 wherein the first support means comprises a radially extending flange engaging the bottom end of the container and located at a distance above the bottom wall of the container, and an inwardly projective annular rim spaced above said flange.

4. A bin as claimed in claim 1 wherein the holding means between the cover and the base are engaged and released by relative rotation between the cover and the base.

5. A bin as claimed in claim 1 wherein the holding means between the cover and base comprise one or more bayonet and slot action devices acting between the cover and base.

6. A bin as claimed in claim 5 wherein the base has an upstanding sleeve with which a lower part of the cover is concentric and the bayonet and slot devices are provided between the sleeve and said lower part of the cover.

7. A bin as claimed in claim 6 wherein the upstanding sleeve is formed with one or more bayonet slots in its outer surface and the lower part of the container encircles the sleeve and is formed with a bayonet pin or pins to engage in the slot or respective slots.

8. A bin as claimed in claim 5 wherein the inner surface of the sleeve is formed with vertical ribs to align the holder on the base.

9. A bin as claimed in claim 5 wherein a locking device is provided for locking the bottom of the cover to the sleeve.

10. A bin as claimed in claim 9 wherein the locking device is mounted on the cover and has a spring loaded peg projecting inwardly of the cover to engage in a recess in the outer surface of the sleeve and means are provided on the locking device for withdrawing the locking pin to permit the cover to be released from the base.

11. A bin as claimed in claim 10 wherein the upper edge portion of the sleeve is formed with a taper to assist in guiding the lower part of the cover onto the sleeve and to cause the locking pin to retract as the cover is located on the base before the pin projects into the recess in the sleeve.

12. A bin as claimed in claim 10 wherein two locking devices are provided at locations spaced around the cover and having projecting pins for engaging in respective recesses in the outer surface of the sleeve.

13. A bin as claimed in claim 1 wherein said first support means comprise a plurality of vertically extending ribs spaced apart around the peripheral wall of said base and having guide surfaces which extend downwardly and inwardly from the peripheral wall to guide and centrally locate the container on said base.

14. A bin as claimed in claim 13 wherein said first support means comprise ledge means, spaced above the bottom wall of the base, for receiving and supporting the container bottom.

15. A refuse bin, comprising:

an open topped, refuse container with a bottom end and an upper end;

a shallow base having a bottom wall, an upstanding peripheral wall encircling the bottom wall, ledge support means within the base disposed around said peripheral wall and located above the bottom wall to receive and support the bottom of the container above the bottom of the base, and vertically extending guide elements disposed around the peripheral wall above said ledge support means, said guide elements having inwardly inclined guide surfaces which converge downwardly toward the ledge support means to guide the bottom of the container as the container is inserted into the base to a central position within the base;

a one-piece removable cover for enclosing the open topped container, the cover being open at one end engaging the base and closed at an opposing end providing a closure over the upper end of the container, the opposing end of the cover projecting beyond the upper end of the container, the cover having a lateral wall with at least one side aperture therein through which refuse may be passed into the container within the cover;

second support means disposed around the peripheral wall of the base below an upper peripheral edge thereof, the open one end of the cover extending around the upper peripheral edge of the base and engaging the second support means; and holding means, provided between the cover at the open one end and part of the peripheral wall of the base extending above the support means for holding releasably the cover on the base.

16. A refuse bin as claimed in claim 15 wherein said ledge support means comprises a plurality of radial lugs spaced around the peripheral wall of the base having upwardly facing horizontal ledges to receive and support the container bottom.

17. A refuse bin as claimed in claim 16 wherein said vertically extending guide elements are formed integrally with said radial lugs above the horizontal ledges thereof and have guide surfaces extending downwardly and inwardly to the horizontal ledges to guide the bottom of the container onto the ledges and hold the container centrally in the base.

18. A refuse bin as claimed in claim 15 wherein the ledge support means comprise a horizontal flange formed on and extending around the peripheral wall of the base to receive the container bottom.

19. A refuse bin as claimed in claim 18 wherein the vertically extending guide elements comprise a plurality of vertically extending ribs on the peripheral wall of the base above said horizontal flange and having inwardly inclined guide faces which converge in a downward direction to receive and guide the container bottom onto said horizontal flange.

20. A refuse bin, comprising: an open topped container for refuse; a shallow base having means to mount the refuse container on the base; and a one piece removable cover for enclosing the refuse container, the cover having a lower periphery which engages with a part of the base to support the cover on the base around the refuse container and having an upper part extending above an upper end of the refuse container and being formed with at least one port disposed above the upper end of the refuse container through which refuse may be passed into the container within the cover; wherein the improvement comprises forming the shallow base with a bottom wall to overlie the ground and an upstanding annular peripheral wall encircling the bottom wall, the peripheral wall being formed with first ledge means disposed around an inner side of said peripheral wall above the bottom wall of the base to receive and support a bottom of the container within the peripheral wall spaced above said bottom wall of the base, the peripheral wall having second ledge means spaced from the first ledge means to receive and support the lower periphery of said cover and inter-engaging locking means on the peripheral wall and the lower periphery of the cover to engage and secure the cover to the base, said peripheral wall having a part extending above the first ledge means to encircle closely a lower peripheral part of the refuse container to stabilize the refuse container on the base.

21. A bin as claimed in claim 20 wherein the inter-engaging locking means between the cover and base are engaged and released by relative rotation between the cover and base.

22. A bin as claimed in claim 21 wherein the inter-engaging locking means between the cover and base comprise a plurality of bayonet elements disposed at locations spaced around the peripheral wall of the base, and a corresponding plurality of bayonet slots in the lower periphery of the cover to receive the bayonet elements.

23. A bin as claimed in claim 22 wherein the lower periphery of the cover locates within the peripheral wall of the base, the bayonet elements being mounted at locations spaced around an inner side of the peripheral wall of the base to engage in the bayonet slots in the lower periphery of the cover.

24. A refuse bin as claimed in claim 21 wherein the lower periphery of the cover is formed with a plurality of bayonet elements at spaced locations; and the peripheral wall of the base is provided with a corresponding number of bayonet slots to receive said bayonet elements.

25. A refuse bin as claimed in claim 24 wherein the lower periphery of the cover extends around an outer side of the peripheral wall of the base, the second ledge means on the peripheral wall of the base encircling an outer side of the peripheral wall of the base below an upper edge thereof to receive a lower peripheral edge of the cover, and a part of the peripheral wall above the second ledge means being formed with said bayonet slots on an outer peripheral side thereof at spaced locations around the peripheral wall and the lower periphery of the cover having a corresponding number of bayonet elements spaced around an inner side of a wall to engage in the slots.

26. A refuse bin as claimed iin claim 20 wherein in first ledge means comprise a plurality of radial lugs spaced around the peripheral wall of the base within the peripheral wall and having upwardly facing horizontal ledges to receive and support the container bottom.

27. A refuse bin as claimed in claim 20 wherein the first ledge means comprises a horizontal flange formed on and extending around an inner side of the peripheral wall of the base to receive the container bottom.

* * * * *